US007097290B2

(12) United States Patent
Yoshida

(10) Patent No.: US 7,097,290 B2
(45) Date of Patent: Aug. 29, 2006

(54) INK SUPPLY FROM THE MAIN TANK TO THE SUB-TANK IN THE PRINTING DEVICE

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 10/684,809

(22) Filed: Oct. 15, 2003

(65) Prior Publication Data

US 2004/0135829 A1 Jul. 15, 2004

(30) Foreign Application Priority Data

Oct. 16, 2002 (JP) ..... 2002-302008

(51) Int. Cl.
*B41J 2/175* (2006.01)

(52) U.S. Cl. ..... 347/85

(58) Field of Classification Search ..... 347/7, 347/85, 5, 84, 94, 95, 43, 86
See application file for complete search history.

(56) References Cited

U.S. PATENT DOCUMENTS 4,694,307 A * 9/1987 Toganoh et al. ..... 347/85
5,367,328 A * 11/1994 Erickson ..... 347/7
6,139,136 A * 10/2000 Mackay et al. ..... 347/85
6,196,668 B1 * 3/2001 Bode ..... 347/85
6,281,916 B1 * 8/2001 VanSteenkiste ..... 347/85
6,471,314 B1 * 10/2002 Doi ..... 347/5
6,481,836 B1 * 11/2002 Paroff et al. ..... 347/85
6,517,189 B1 * 2/2003 Ogawa et al. ..... 347/35
6,883,905 B1 * 4/2005 Kimura et al. ..... 347/85

FOREIGN PATENT DOCUMENTS

JP 2001-232806 A 8/2001
JP 2002-307707 A 10/2002

* cited by examiner

*Primary Examiner*—K. Feggins
*Assistant Examiner*—Rene Garcia, Jr.
(74) *Attorney, Agent, or Firm*—Sughrue Mion, PLLC

(57) ABSTRACT

A printing apparatus of the invention prints images by ejecting ink from nozzles onto a printing medium. The printing apparatus includes a first sub-tank which is set at the relatively high position, a second sub-tank which is set at the relatively low position (position set relative to one another), and a main tank which holds ink to be supplied to the first and second sub-tanks. When ink is supplied to the first sub-tank, the ink is supplied from the main tank with relatively high pressure. When ink is supplied to the second sub-tank, the ink is supplied from the main tank with relatively low pressure. The first and second pressures are pressures such that ink is not ejected from the opening of the nozzles when ink is supplied from the main tank to the sub-tanks in the situation that ink can be supplied from the sub-tank to the opening of the nozzles. With this printing apparatus, ink can be supplied efficiently from the main tank to the sub-tanks arranged at the different heights.

19 Claims, 12 Drawing Sheets

Fig.12

| Number of sub-tank Nt \ Sub-tank group | G1 | G2 | G3 |
|---|---|---|---|
| 1 or 2 | P11 | P12 | P13 |
| 3 or 4 | P21 | P22 | P23 |
| 5 or 6 | P31 | P32 | P33 |

INK SUPPLY FROM THE MAIN TANK TO THE SUB-TANK IN THE PRINTING DEVICE

BACKGROUND OF THE INVENTION

1. Field of the Invention

The present invention relates to a technique for performing printing by depositing dots on a printing medium, and more particularly to a technique for the efficient supply of ink from the main tank to the sub-tanks that are arranged at different heights in the printing apparatus.

2. Description of the Related Art

In recent years, the ink jet printer has come into widespread use as an image-printing device. Among such printers, there are those that include a main tank and a plurality of sub-tanks as the ink holding tank. The sub-tanks are provided on the carriage, and the main tank is provided outside of the carriage. Ink held in the sub-tank is used for printing, and then ink is replenished from the main tank during the period between printings. The supply is made at once for each of the sub-tanks having low levels of remaining ink. Such a technique is disclosed, for example, in JP2001-232806A.

In this type of printer, in which sub-tanks are provided at different heights, it is preferable that ink is supplied at a certain pressure that allows ink to be supplied to the sub-tank at the highest position. However, because ink is supplied with such pressure from the main tank, the ink supplied to the sub-tank in the lowest position sometimes seeps out from the nozzle because of the high pressure. Accordingly, when ink is supplied to the sub-tanks, the carriage is moved to the refuge area and is capped by its nozzle surface.

The present invention was designed to address this problem. Accordingly, one object of the present invention is to provide ink efficiently from the main tank to the sub-tanks which are located at different heights in the printing device.

SUMMARY OF THE INVENTION

To address at the least a portion of the above-mentioned problem, the present invention carries out predetermined processing intended for a printing apparatus, which performs printing by ejecting ink from nozzles onto a printing medium. This printing apparatus comprises: a plurality of nozzles for ejecting ink drops; a first sub-tank which is provided at a relatively high position (relative to other sub-tanks or groups) and which holds ink to be supplied to one part of the plurality of the nozzles; a second sub-tank which is provided at a relatively low position (relative to the first sub-tank) and which holds ink to be supplied to another part of the plurality of the nozzles; a main tank which is connected to the first and second sub-tanks and holds ink to be supplied to the first and second sub-tanks; an ink supplying line which is used for supplying ink to both the first and second sub-tanks; and an ink replenishment unit which is configured to supply ink from the main tank to the first and second sub-tanks selectively.

In such a printing device, when the ink is supplied to the first sub-tank, ink is supplied from the main tank to the first sub-tank at a first pressure that is relatively high at an ink supplying line used for supplying ink to both of the first and second sub-tanks. When the ink is supplied to the second sub-tank, ink is supplied from the main tank to the second sub-tank at a second pressure that is relatively low (relative to the first pressure) at the ink supplying line. Such an embodiment allows ink to be supplied to the first sub-tank located at a relatively high position, and also allows ink to be supplied at a pressure that is not too high for the second sub-tank located at a relatively low position.

It is preferable that the first pressure is a pressure such that ink does not seep out from the nozzle when ink is supplied from the main tank to the first sub-tank. Similarly, it is also preferable that the second pressure is a pressure such that ink does not seep out from the nozzle when ink is supplied from the main tank to the second sub-tank. In such an embodiment, the printing medium or other elements of the printing device remain unsoiled because no ink leaks out from the nozzle during ink supply to the sub-tanks.

In the printing device including a carriage which reciprocates at a position where the carriage faces a printing medium, it is preferable that the plurality of the nozzles and the first and second sub-tanks are provided on the carriage. In this embodiment, ink can be supplied from the sub-tanks to nozzles at a steady flow rate and pressure.

In the case where the printing device is provided with a plurality of the first sub-tanks, a remaining amount monitoring unit can be provided that can determine whether the remaining amount of ink in the plurality of first sub-tanks is below a threshold level. In this case, the following embodiment is preferable. In the embodiment, ink is supplied simultaneously from the main tank to one or more first sub-tanks of which the remaining amount of ink is below the threshold. Ink is supplied from the main tank at a relatively high amount of ink per unit time when ink is supplied simultaneously to a relatively large number of first sub-tanks. On the other hand, ink is supplied from the main tank at a relatively low amount of ink per unit time when the ink is simultaneously supplied to a relatively small number of first sub-tanks.

In the case where the printing device includes a plurality of the second sub-tanks, the remaining amount monitoring unit can also determine whether the remaining amount of ink in the plurality of second sub-tanks is below a threshold level. In this case, the following embodiment is preferable. In the embodiment, ink is supplied simultaneously from the main tank to one or more second sub-tanks of which the remaining amount of ink is below the threshold. Ink is supplied from the main tank at a relatively high amount of ink per unit time when ink is supplied simultaneously to a relatively large number of second sub-tanks. On the other hand, ink is supplied from the main tank at a relatively low amount of ink per unit time when the ink is simultaneously supplied to a relatively small number of second sub-tanks.

Such an embodiment allows the sub-tanks to be refilled with ink sooner than embodiments in which ink is supplied at a constant feed that is not based on the number of sub-tanks to which ink is supplied whenever ink is simultaneously supplied to a relatively large number of sub-tanks.

In another possible embodiment, ink may be supplied from the main tank at the first pressure when ink is supplied simultaneously to a relatively small number of first sub-tanks. On the other hand, ink may be supplied from the main tank at a pressure higher than the first pressure when the ink is simultaneously supplied to a relatively large number of first sub-tanks.

Similarly, ink may be supplied from the main tank at the second pressure when ink is supplied simultaneously to a relatively large number of second sub-tanks. On the other hand, ink may be supplied from the main tank at a pressure lower than the second pressure when the ink is simultaneously supplied to a relatively small number of second sub-tanks.

This embodiment allows the sub-tanks to be refilled sooner than embodiments in which ink is supplied at a constant feed that is not based on the number of sub-tanks to which ink is supplied whenever ink is simultaneously supplied to a relatively large number of sub-tanks.

The present invention can be realized in a variety of forms, such as printing methods and printing devices, printing control methods and printing control devices, computer programs incorporating instructions for the above methods or devices, recording media for recording such computer programs, data signals realized in carrier waves including computer programs, and the like.

These and other objects, features, aspects, and advantages of the present invention will become more apparent from the following detailed description of the preferred embodiments and the accompanying drawings.

BRIEF DESCRIPTION OF THE DRAWINGS

FIG. 12 shows a table for defining the value of the pressure of compressed air supplied by the air pressure pump.

DETAILED DESCRIPTION OF THE INVENTION

Features of the embodiments of the present invention will be explained in detail below in the following order.

Figure 1:
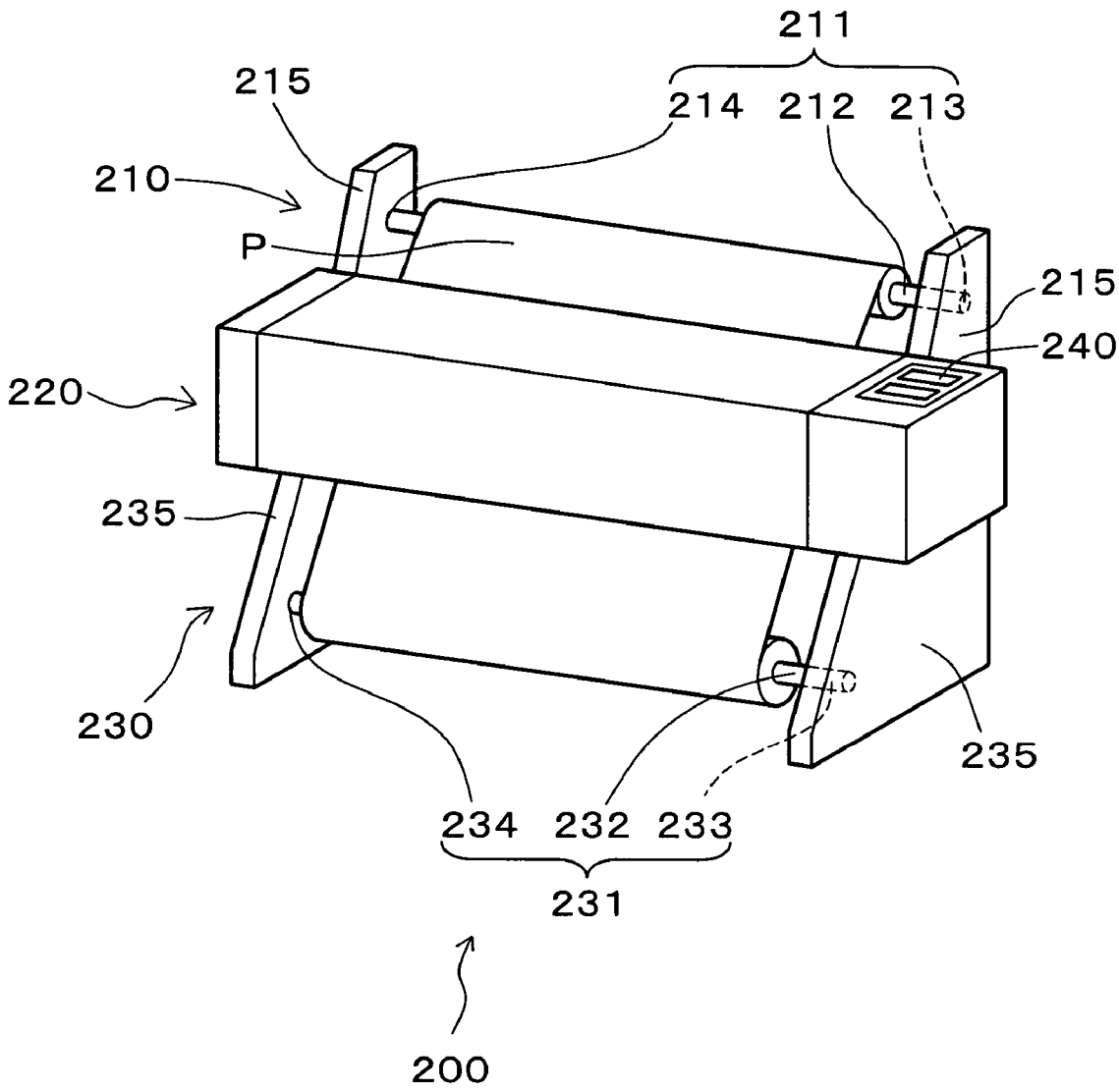
FIG. 1 is a perspective figure showing the outline of the constitution of a printer as one embodiment of this invention.

A. Constitution of Device:

A1. Constitution of the whole printer:

A2. Constitution of the ink supplying system:

A3. Constitution of the control unit:

B. Ink supply to the sub-tanks:

B1. Ink supply while executing the printing of image:

B2. Ink supply between the printings of images:

C. Variation:

C1. Variation 1:

C2. Variation 2:

C3. Variation 3:

C4. Variation 4:

C5. Variation 5:

C6. Variation 6:

A. Constitution of Device:

A1. Constitution of the printer:

FIG. 1 is a perspective figure showing the outline of a printer 200 as one embodiment of the invention. Printer 200 in this embodiment is a type that can handle relatively big printing paper P, e.g. A0 size or B0 size paper of JIS (Japan Industrial Standard) or roll paper. The printing paper P is provided from a paper feeding unit 210 to a printing unit 220. The printing unit 220 executes the printing by ejecting ink droplets to the provided printing paper P. The printing paper P printed in the printing unit 220 is then conveyed to a paper discharging unit 230.

The paper feeding unit 210 is equipped with a roll paper holder 211 that can be set to use the roll paper as the printing paper P. The roll paper holder 211 comprises a spindle 212 that holds the roll paper, and first and second spindle housings 213, 214 that enable the spindle 212 to be placed on, suspended, and taken off. The two spindle housings 213, 214 are supported by two supporting frames 215 respectively that are equipped on the upper part of the printer 200. The spindle 212 is set on the first and second spindle housings 213, 214 by its ends after the roll paper is set on its middle portion.

The paper discharging unit 230 is equipped with a rewinding holder 231 operable to rewind the roll paper. The rewinding holder 231 comprises a spindle 232 that rewinds the roll paper printed by printing unit 220, and first and second spindle housings 233, 234 that enable the spindle 212 to be placed on, suspended, and taken off. The two spindle housings 233, 234 are supported by two supporting frames 235 respectively that are equipped on the lower part of the printer 200. The spindle 232 is configured so that it can be set on the first and second spindle housings 233, 234 by its ends, and then be rolled by a non-illustrated driving unit. In other embodiments, the printer may be configured so that the spindle 212 is rolled by the driving unit and thereby it rewinds the roll paper from the bottom up. Or, the printer may include a paper conveying means, e.g. paper discharging rollers, that can be equipped inside the printing unit 220 and the printing paper can be moved out by driving the paper conveying means as described below.

On the upper surface of the printing unit 220, an interface unit 240 is equipped as the input unit by which the printing modes can be input.

Figure 2:
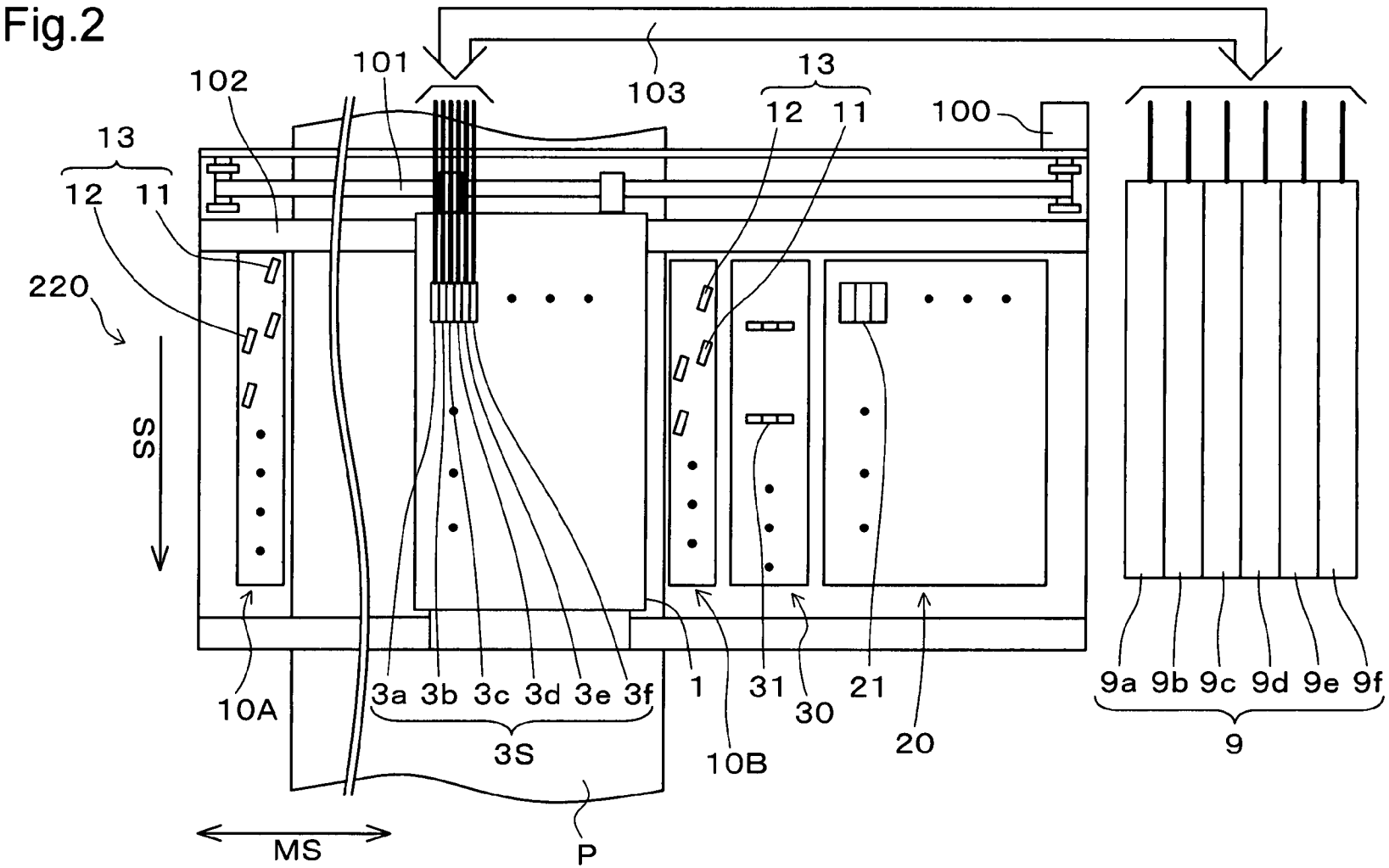
FIG. 2 is an explanatory figure that shows the configuration of the printing unit.

FIG. 2 is an explanatory figure that shows the configuration of the printing unit 220. The printing unit 220 comprises a carriage 1 that is equipped with a plurality of print heads (described below). On the carriage 1, a plurality of sub-tank sets 3S are set. The sub-tank set 3S temporarily pools ink to be provided to the print head. The carriage 1 is connected to a driving belt 101 that is driven by carriage motor 100, and can be moved along the main scanning direction MS with the guide of a main scan guide units 102. In this embodiment, sub-tanks are equipped on the carriage. Accordingly, the sub-tanks can provide ink to the nozzles at a consistent or steady flow rate and pressure.

The first inspection unit 10A and the second inspection unit 10B are equipped in the area of the both outsides of the printing paper P in the motion range of the carriage 1 along the main scanning. By the side of the second inspection unit 10B, a wiper unit 30 that executes the wiping of nozzles, a cap unit 20 that seals nozzle groups and executes cleaning, and a main tank 9 that supplies ink to the sub-tank set 3S are equipped.

The carriage 1 executes printing by ejecting ink from the nozzle to printing paper P while moving along the main scanning direction in the position of facing to the printing paper P. When printing is not executed, the carriage 1 moves to the position of facing to the cap unit 20.

The sub tank sets 3S and the main tank 9 are connected by ink supplying lines 103. In this embodiment, there are sub-tanks 3*a* to 3*f* for 6 kinds of ink, i.e. black K, cyan C, light cyan LC, magenta M, light magenta LM and yellow Y. Each of the sub-tanks 3*a* to 3*f* is connected to correspond to one of 6 main tanks 9*a*–9*f* respectively. Hereinafter, in the explanation of each element or each function of the printer with the sub-tanks 3*a* to 3*f* and main tanks 9*a*–9*f*, the sub-tank is referred as the sub-tank 3 and the main tank is referred as the main tank 9 when the distinction of 6 ink colors is not needed.

The number of available kinds of ink in the printer of this embodiment is not limited to 6. As a non-limiting example, 4 kinds of inks (e.g. black K, cyan C, magenta M, and yellow Y) or 7 kinds of inks (e.g. black K, light black LK, cyan C, light cyan LC, magenta M, light magenta LM and yellow Y) may also be used in the printer. As such, the number of the kinds of ink to be used is left for the user to decide, based on the appropriate application.

Figure 3:
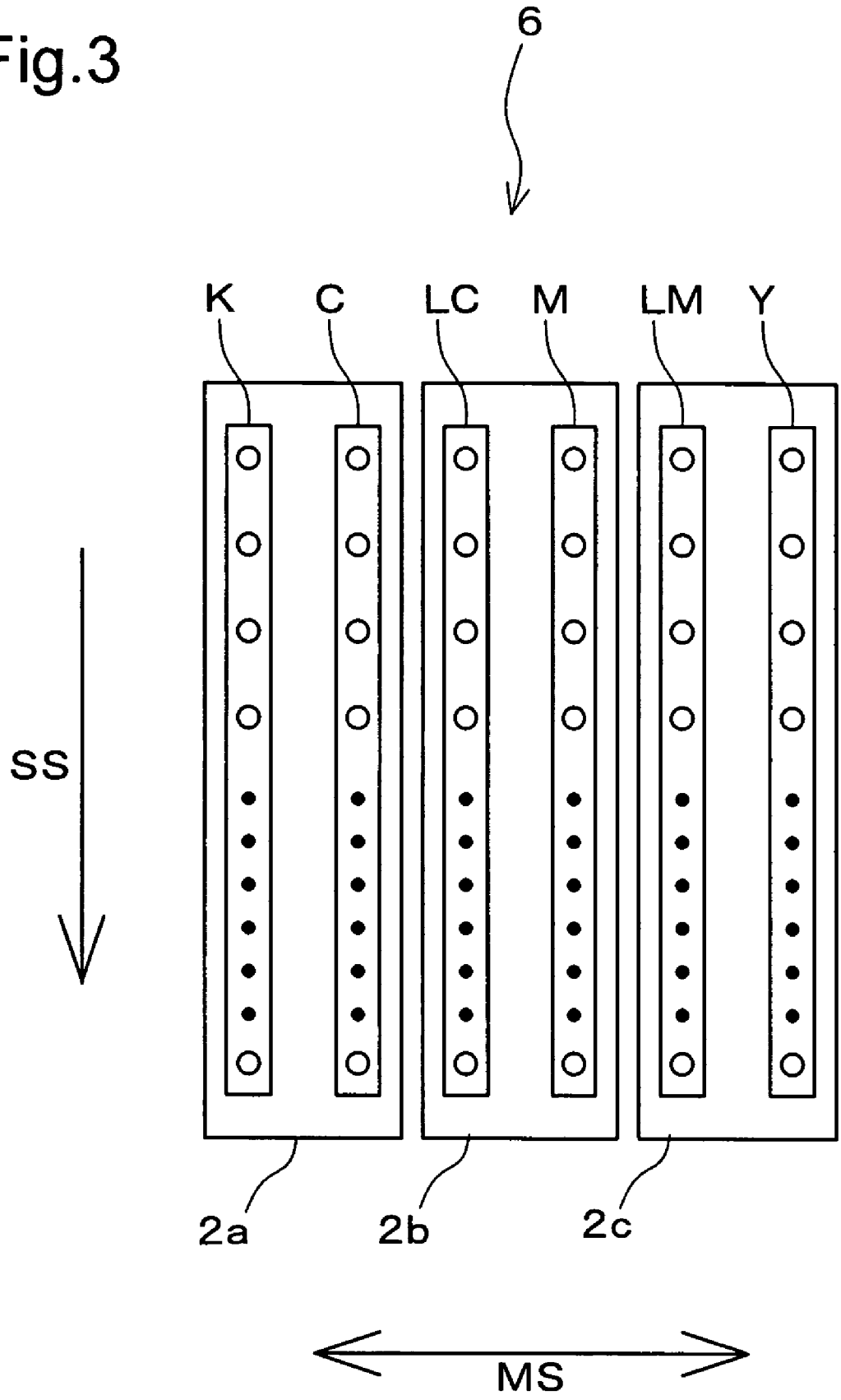
FIG. 3 shows the alignment of the nozzles on the under surface of a print head of the invention.

FIG. 3 shows the alignment of the nozzles on the under surface of one print head 6. The print head 6 includes three nozzle plates 2*a*, 2*b* and 2*c*. On the under surface of each nozzle plate, 2 nozzle groups (nozzle rows) are equipped from which different color ink is ejected. Accordingly, the print head 6 includes 6 nozzle groups as a whole. In this embodiment, different ink is dispatched to each nozzle group respectively. Of course, the same ink may be ejected from a plurality of nozzle groups.

Figure 4:
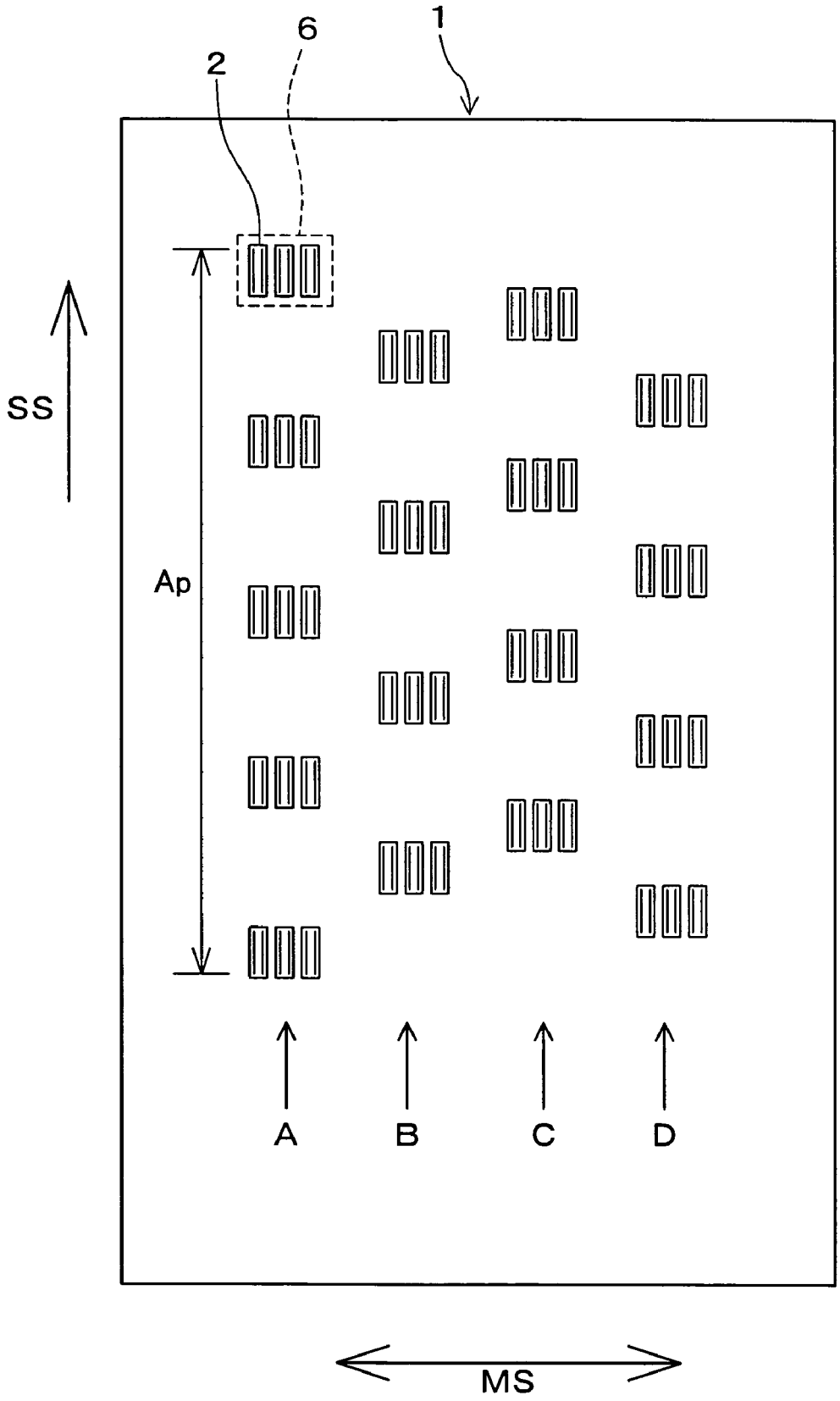
FIG. 4 shows the outline of the constitution of a carriage.

FIG. 4 shows the outline of carriage 1 of the invention. In this embodiment, 17 sets of print heads 6 are arranged on the carriage 1. Each print head 6 is located at a different position in the sub-scanning direction SS and includes nozzles of Black K, Cyan C, Light Cyan LC, Magenta M, Light Magenta LM and Yellow Y (See FIG. 3). The nozzles of each color are evenly spaced in the sub-scanning direction in the range shown by arrow Ap. Accordingly, this printer can print a relatively broad area at once and can complete printing in a short time, even on large-sized printing paper.

Figure 5:
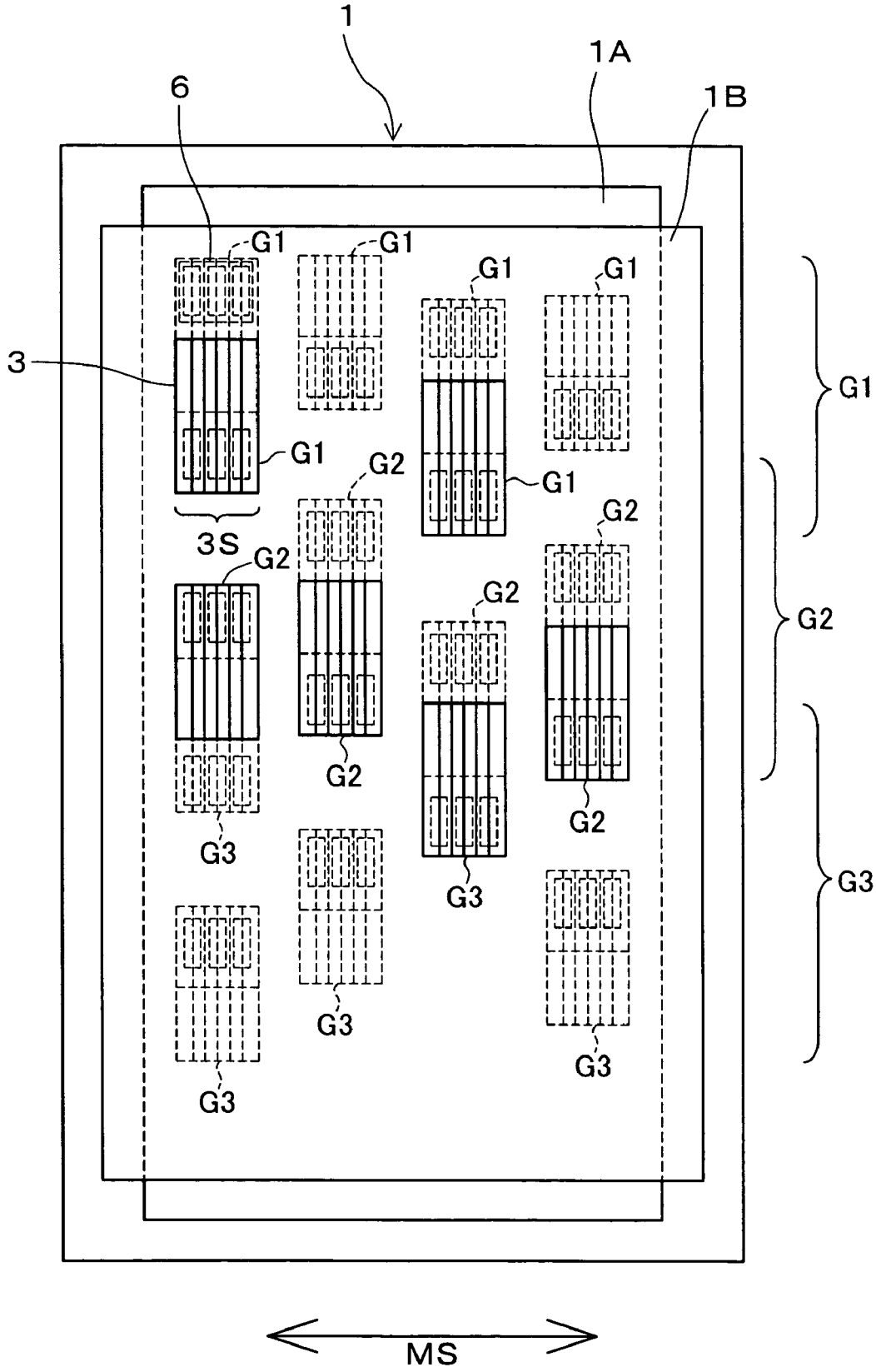
FIG. 5 shows the outline of the alignment of sub-tanks mounted on the carriage.

FIG. 5 shows the outline of the alignment of the sub-tanks 3 mounted on the carriage 1. In FIG. 5, the lines that can be seen are shown as thick lines and the lines that can not be seen behind some objects are shown as thin broken lines. On the carriage, one sub-tank set 3S is arranged for each print head 6. In this embodiment, all sub-tank sets 3S can not be arranged in the same plane on the carriage. Accordingly, sub-tank sets 3S are broken into two groups arranged respectively on sub-tank plates 1A and 1B that are equipped on the carriage 1. In the embodiment shown in FIG. 5, the sub-tank plate 1B is equipped above the sub-tank plate 1A. Accordingly, sub-tanks arranged on the sub-tank plate 1B are shown as thick lines. The number of the sub-tank plates is not limited to two and can be one or more than 3 according to the number of sub-tanks 3.

The 17 sub-tanks on the carriage are divided into 3 sub-tank groups G1–G3 according to the positions in which each sub-tank is arranged. The 6 sub-tanks in the upper most area in FIG. 5 belong to sub-tank group G1. The 5 sub-tanks in the lower most area in FIG. 5 belong to sub-tank group G3. The 6 sub-tanks in the middle area, which do not belong to the sub-tank group G1 or G3, belong to sub-tank group G2.

Figure 6:
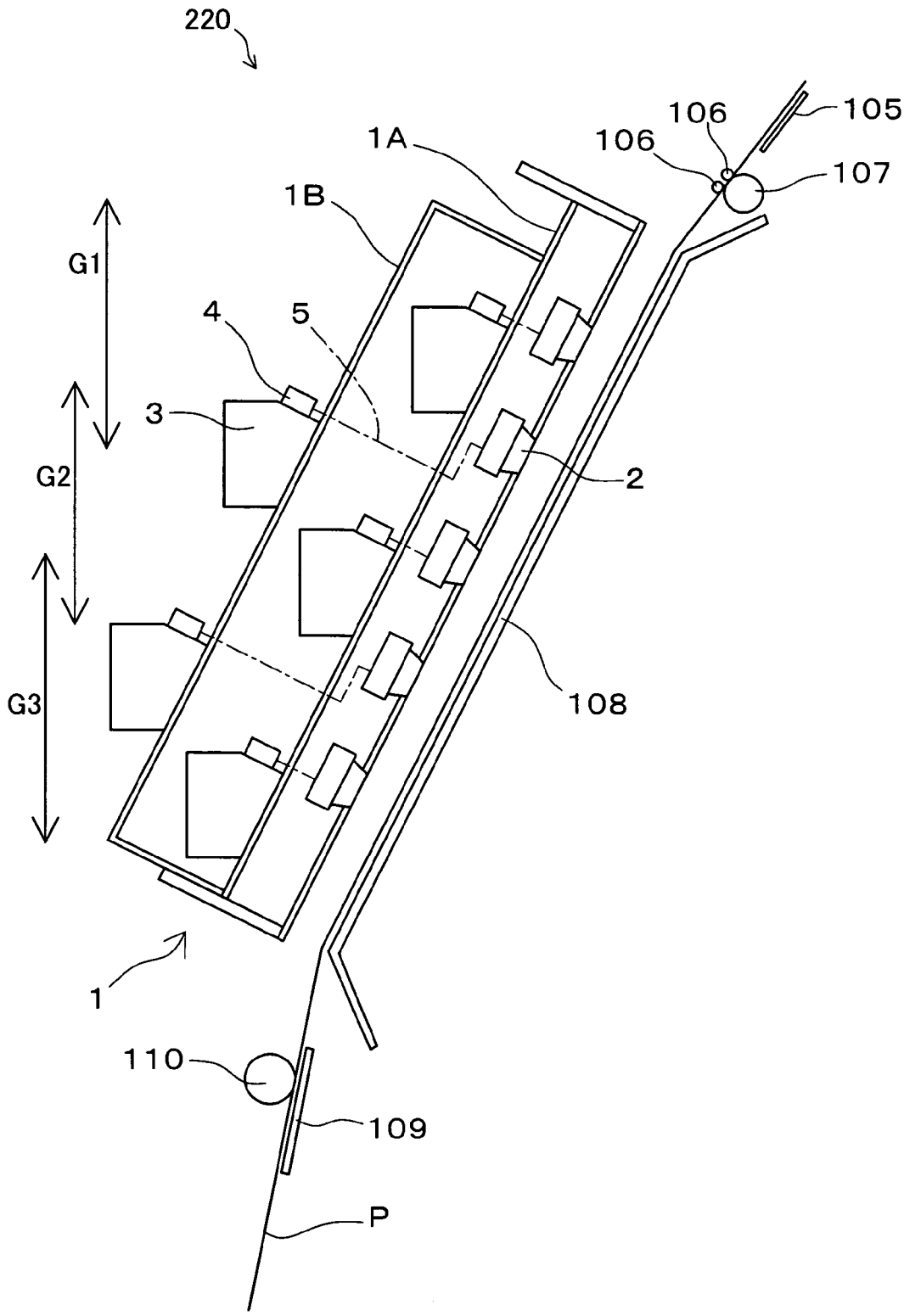
FIG. 6 shows the printing unit including the carriage.

FIG. 6 shows the printing unit 220 including carriage 1. The printing paper P is fed along the printing paper feeding path which is set from the posterior superior portion (the upper right portion in FIG. 6) of the printer 200 to the anterior inferior portion (the lower left portion in FIG. 6) of the printer 200. The printing paper P is printed in the path and then ejected to the paper discharging unit 230 (See FIG. 1).

In FIG. 6, the ranges G1 to G3 are shown. These ranges G1 to G3 are the range in which sub-tanks 3 of the sub-tank groups G1 to G3 are arranged respectively. As shown in FIGS. 1 and 6, the carriage 1 is set to the printer in the situation inclined to the horizontal plane. Accordingly, the sub-tanks belonging to the sub-tank group G1 are positioned in the upper most area and the sub-tanks belonging to the sub-tank group G3 are positioned in the lower most area. The sub-tanks belonging to the sub-tank group G2 are positioned in the middle area.

For details, the lower most sub-tank in the sub-tank group G1 is set in the upper position than the higher most sub-tank in the sub-tank group G2. The lower most sub-tank in the sub-tank group G2 is set in the upper position than the higher most sub-tank in the sub-tank group G3. "The position" of each sub-tank means the position of the lower edge of the tank containing ink.

Along the printing paper feeding path, a paper feed guide 105, paper feed rollers 106, a driven roller 107 that is set in the face of paper feed rollers 106, a printing stage 108 that is set aslant, the carriage 1 that is set in the face of the printing stage 108, a paper ejecting guide 109, and a paper ejecting roller 110 that is set in the face of the paper ejecting guide 109 is are arranged in the order from the side of the paper feeding unit 210 (which corresponds to the upper right side in FIG. 6).

The paper feed guide 105, the printing stage 108 and the paper ejecting guide 109 are configured to be flat respectively and the printing papers are feed along their flat surfaces. The printing papers are kept flat along the surfaces while they are fed. Accordingly, even in the case where relatively big printing papers are printed, the printing papers are not crimped and the images printed on the printing papers are not deformed.

A plurality of sub-tanks 3 are mounted respectively on two layers of the sub-tank plates 1A, 1B on the carriage 1. Each sub-tank 3 has a valve 4. The print head 6 and the sub-tank 3 are connected by an ink supplying channel 5 equipped with a valve 4. In this embodiment, one print head 6 includes 6 nozzle groups. Accordingly, 6 sub-tanks 3*a* to 3*f* (see FIG. 2) are connected to one print head 6. Ink supply to each of the 6 nozzle groups can be stopped separately by closing each valve 4 properly.

Each sub-tank 3 is set in such position that the relationship between the height of sub-tank 3 and height of the corresponding nozzle plate 2 is substantially constant regardless of the position of the nozzle plate 2. This reduces the variation of the differences of the water heads between the sub-tank 3 and the nozzle plate 2. Accordingly, the variations of the ink ejection volumes that derive from the variation of the differences of the water heads are reduced. Accordingly, the constant quality of a printed image can be achieved with this embodiment.

Each sub-tank is set in a certain position so that the fluid level of the ink in the sub-tank 3 is consistently lower than the position of the opening of the nozzle to which each sub-tank 3 provides ink. In other words, even when ink is filled to the upper limit in the sub-tank 3, the fluid level of the ink is lower than the position of the opening of the nozzle to which the ink is provided. In the path from the sub-tank 3 to the opening of the nozzle, a piezoelectric element is provided. In this configuration, the ink can be ejected from the nozzle by drawing up the ink from the sub-tank 3 using the piezoelectric element. This embodiment can eject the ink from the nozzles with more stable flow volume and pressure than the embodiment in which the position of the opening of the nozzle is lower than the fluid level of the ink and the ink flows down from the sub-tank.

In some embodiments of the invention, the position of each sub-tank 3 can be adjusted. In this arrangement, ink ejecting volumes can be controlled by regulating the differences of the water heads by adjusting the positions of the sub-tanks 3, when the print head has the relatively large variety of ink ejecting volumes. In other embodiments, the sub-tank 3 and the nozzle plate 2 can be fixed together on the carriage 1. In such an embodiment, the replacement of sub-tank 3 and nozzle plate 2 can be done easily.

Figure 7:
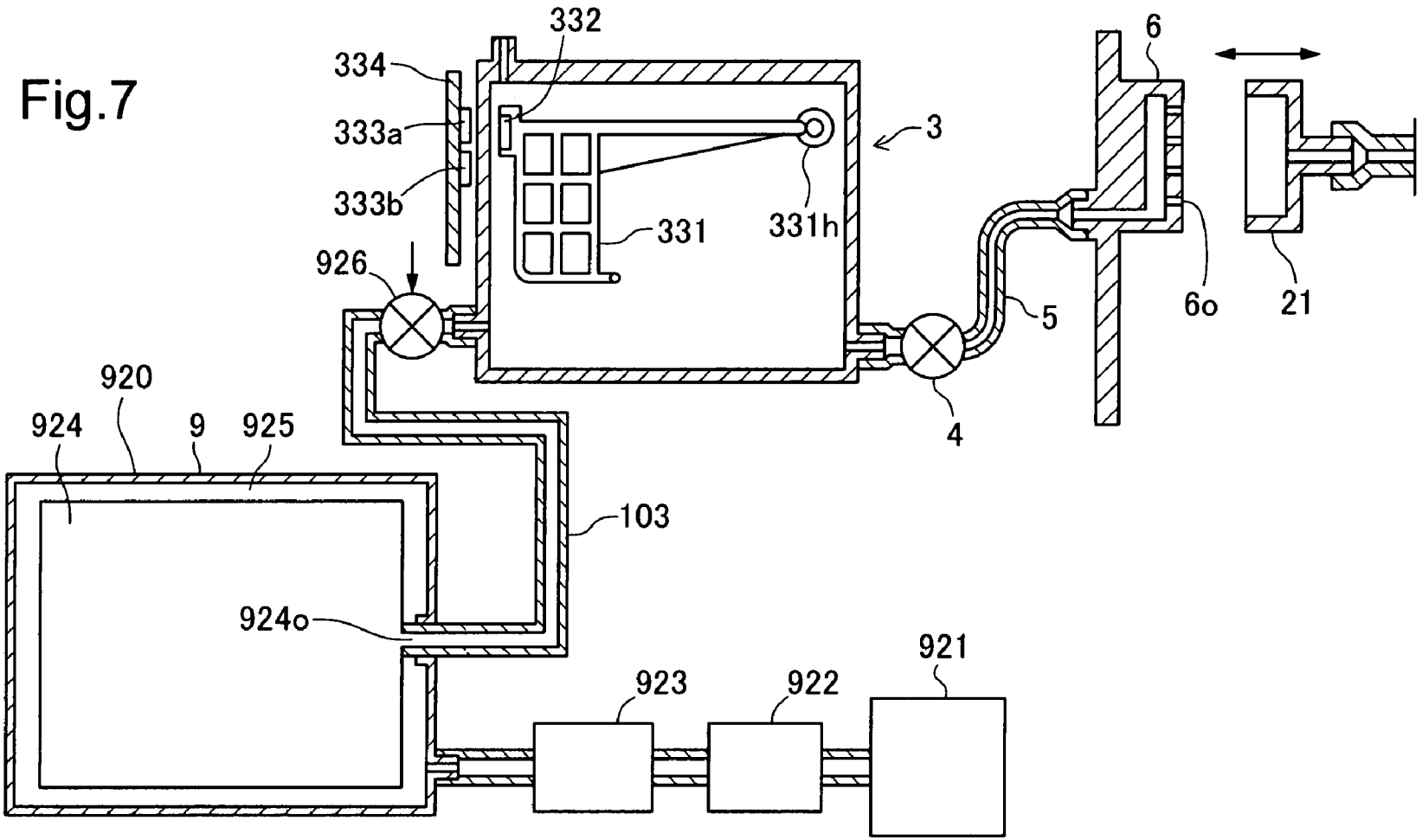
FIG. 7 shows the constitution of the ink supplying system.

A2. Constitution of the ink supplying system:

FIG. 7 shows the constitution of the ink supplying system. This ink supplying system supplies ink to the nozzle on the print head 6. This ink supplying system comprises a main tank 9, sub-tank 3 and an air pressure pump 921.

The main tank 9 comprises an outer case 920 and an ink holding bag 924 in the outer case 920. The ink holding bag 924 is a soft bag having the flexibility and holding ink to be supplied to the sub-tank 3. The ink holding bag 924 has an ink supplying aperture 924*o* for supplying ink out of the outer case 920. The outer case 920 is an air sealing box and the internal space of the outer case 920 composes a pressure chamber 925. When compressed air is supplied to the pressure chamber 925, the ink holding bag 924 is compressed and then the ink is discharged to outside of the main tank 9 through the ink supplying aperture 924*o*. The ink discharged from the main tank 9 is supplied to the sub-tank 3 on the carriage 1 through the ink supplying line 103 and an ink supplying valve 926.

The printer 200 comprises an air pressure pump 921 for supplying compressed air to the main tank 9 with a certain pressure, a pressure adjusting valve 922 for adjusting the pressure of the air compressed by the air pressure pump 921, and a pressure sensor 923 for measuring the pressure of the air that is adjusted by the pressure adjusting valve 922. The air compressed by the air pressure pump 921 is adjusted to its pressure by the pressure adjusting valve 922, and then supplied to the pressure chamber 925 in the main tank 9.

The air supplying line of the compressed air branches off in the downstream of the pressure sensor 923 and each branch is connected to each main tank 9*a* to 9*f* (See FIG. 2), although that is not shown in FIG. 7. The ink supplying lines 103 branches off in the downstream of the ink supplying aperture 924*o* and each branch is connected to each sub-tank on the 17 print heads 6, although that is not shown in FIG. 7. Ink can be supplied to each sub-tank selectively by opening and shutting corresponding ink supplying valves 926 in each ink supplying line or the branch. In other words, there are a certain number of branches which includes the part of the ink supplying line 103 from the ink supplying valve 926 to each sub-tank in the ink supplying line. The number of the branches is equal to the number of the sub-tanks connected to one main tank 9.

The air pressure pump 921 is controlled based on the value of the air pressure that is measured by the pressure sensor 923. When the pressure sensor 923 detects the fact that the pressure of the air compressed by the air pressure pump 921 reaches the upper limit, the air pressure pump 921 is stopped. After that, when the pressure sensor 923 detects the fact that the pressure of the air reaches the lower limit, the air pressure pump 921 is started driving. Accordingly, the pressures of the air supplied to each main tank 9*a* to 9*f* are regulated in a certain range. The control circuit 40 can set the values of the upper and lower limits of the air pressure as appropriate values. Accordingly, the compressed air can be supplied with two or more different pressures by the air pressure pump 921 and the pressure adjusting valve 922 according to the instruction by the control circuit 40 of the printer 200. The pressure adjusting valve 922 releases the compressed air when the air pressure increases excessively, for example, by malfunction. In this embodiment, the air pressure pump 921, the supplying line of the compressed air, the outer case 920 of the main tank 9, the ink supplying lines 103 and the ink supplying valve 926 consist of the ink replenishment unit.

The sub-tank 3 holds the ink supplied from the main tank 9 and supplies it to the nozzles. In the inner space of the sub-tank 3, a float unit 331 is equipped so that it can rotate around the fulcrum 331*h*. The float unit 331 can rotate in the plane perpendicular to the fluid level (the horizontal plane) in the situation that the sub-tank 3 is mounted on the carriage 1. The vertical position of the float unit 331 changes according to the height of the fluid level of the ink in the sub-tank 3. A permanent magnet 332 is mounted on a part of the float unit 331. Meanwhile, in the position in the face of the permanent magnet 332 on the outer wall of the sub-tank 3, magneto electric conversion devices 333*a*, 333*b*, e.g. the hall element typically, are mounted through a substrate 334. When the vertical position of the permanent magnet 332 on the float unit 331 varies, the volume of the lines of the magnetic force that is received by the magneto electric conversion devices 333*a*, 333*b* from the permanent magnet 332 varies accordingly. Consequently, the electric output of magneto electric conversion devices 333*a*, 333*b* varies and the remaining amount of the ink in the sub-tank 3 is evaluated based on it.

The ink in the sub-tank is supplied to the print head 6 via the valve 4 and the ink supplying channel 5 connected to the valve 4. When the actuator in the print head 6 is driven, the ink is ejected from the nozzle opening 6*o* formed on the nozzle arranging surface.

When the amount of consumption overreaches the certain volume after the sub-tank is filled with ink, the ink supplying valve 926 is opened and the ink compressed in the main tank 9 is supplied to the sub-tank 3 via the ink supplying lines 103. After that, when the hall elements 333*a*, 333*b* detect the fact that the volume in the sub-tank 3 reaches the certain upper limit, the ink supplying valve 926 is closed and the ink supply is stopped.

Figure 8:
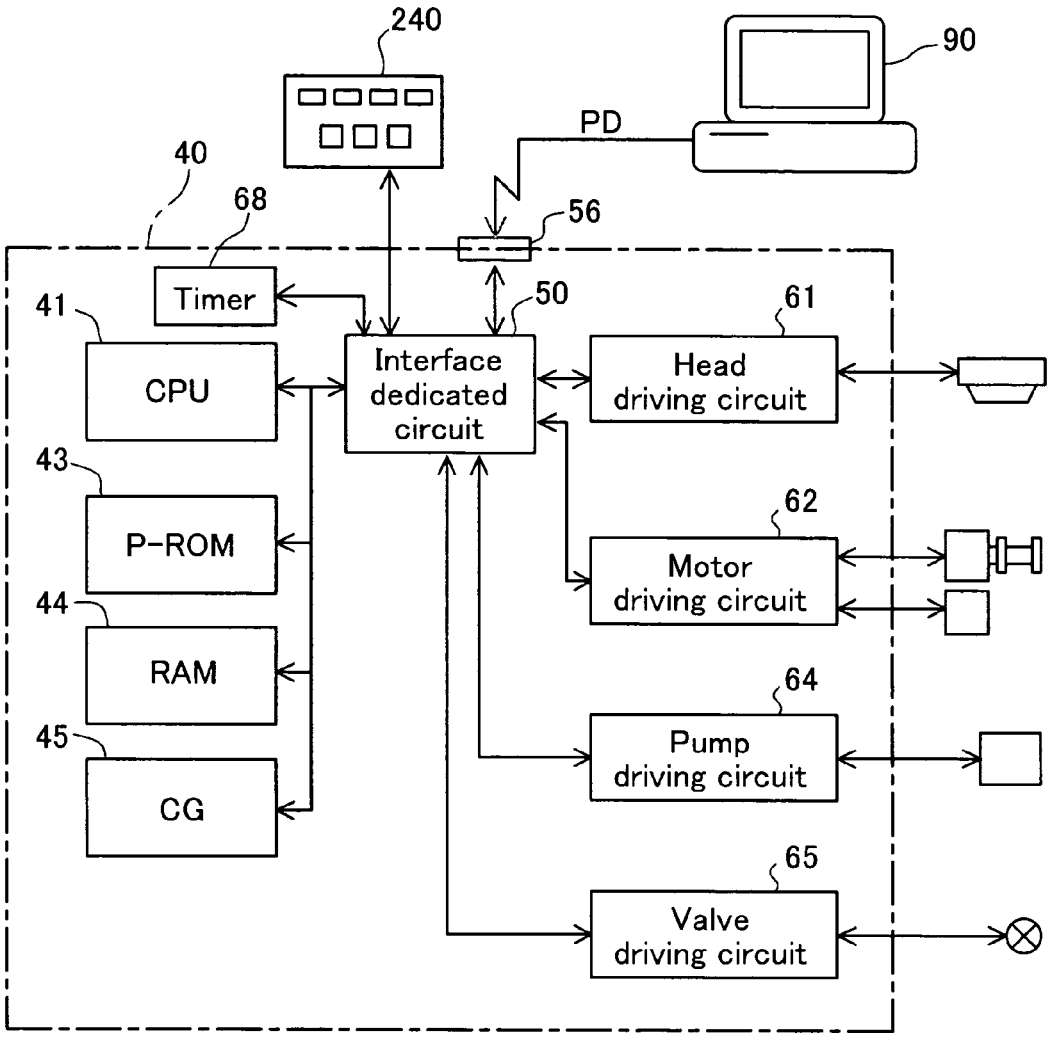
FIG. 8 shows the constitution of the printer including the control circuit as the control unit.

A3. Constitution of the Control Unit:

FIG. 8 shows the constitution of the printer 200 including the control circuit 40 as the control unit. This printing system includes a computer 90 as a print control device. In the broad sense, the set of the printer 200 and computer 90 can be called a printing device.

The control circuit 40 includes a CPU 41, a programmable ROM (PROM) 43, RAM 44, and a character generator (CG) 45 in which is stored a character matrix. The control circuit 40 is configured as an arithmetical logic processing circuit. This control circuit 40 further includes: an interface (I/F) dedicated circuit 50 which is configured as the dedicated interface between external elements (e.g. the motor); a head driving circuit 61 which is connected to the I/F dedicated circuit 50 and drives the print head 6 to eject ink from nozzle plate 2; a motor driving circuit 62 which drives the paper feed motor and the carriage motor 100; a pump driving circuit 64 which drives the air pressure pump 921; a valve driving circuit 65 which drives each valve; and an input/output unit 240 as input unit.

B. Ink supply to the sub-tanks:

B1. Ink supply while executing the printing of image:

The CPU 41 in the printer 200 monitors the fluid level of the ink in the sub-tank 3 with the magneto electric conversion devices 333*a*, 333*b* while printing is executed. The CPU 41 calculates the remaining amount of the ink based on the signals from the magneto electric conversion devices 333*a*, 333*b*. The CPU 41 checks whether the remaining amount of the ink in each sub-tank 3 goes below the first threshold Th1. The set of float unit 331, the magneto electric conversion devices 333*a*, 333*b*, and the CPU 41 comprise a remaining amount monitoring unit.

The CPU 41 provides instruction to supply ink from the main tank 9 to the sub-tank of which the ink remaining amount is below the first threshold Th1 using the following procedure. In the following paragraphs, the procedure is explained using one pair of the main tank and the sub-tank 3. But, the ink supply from the main tank to sub-tank 3 is executed similarly for 6 sub-tanks, 3 on each of 17 print heads.

Figure 9:
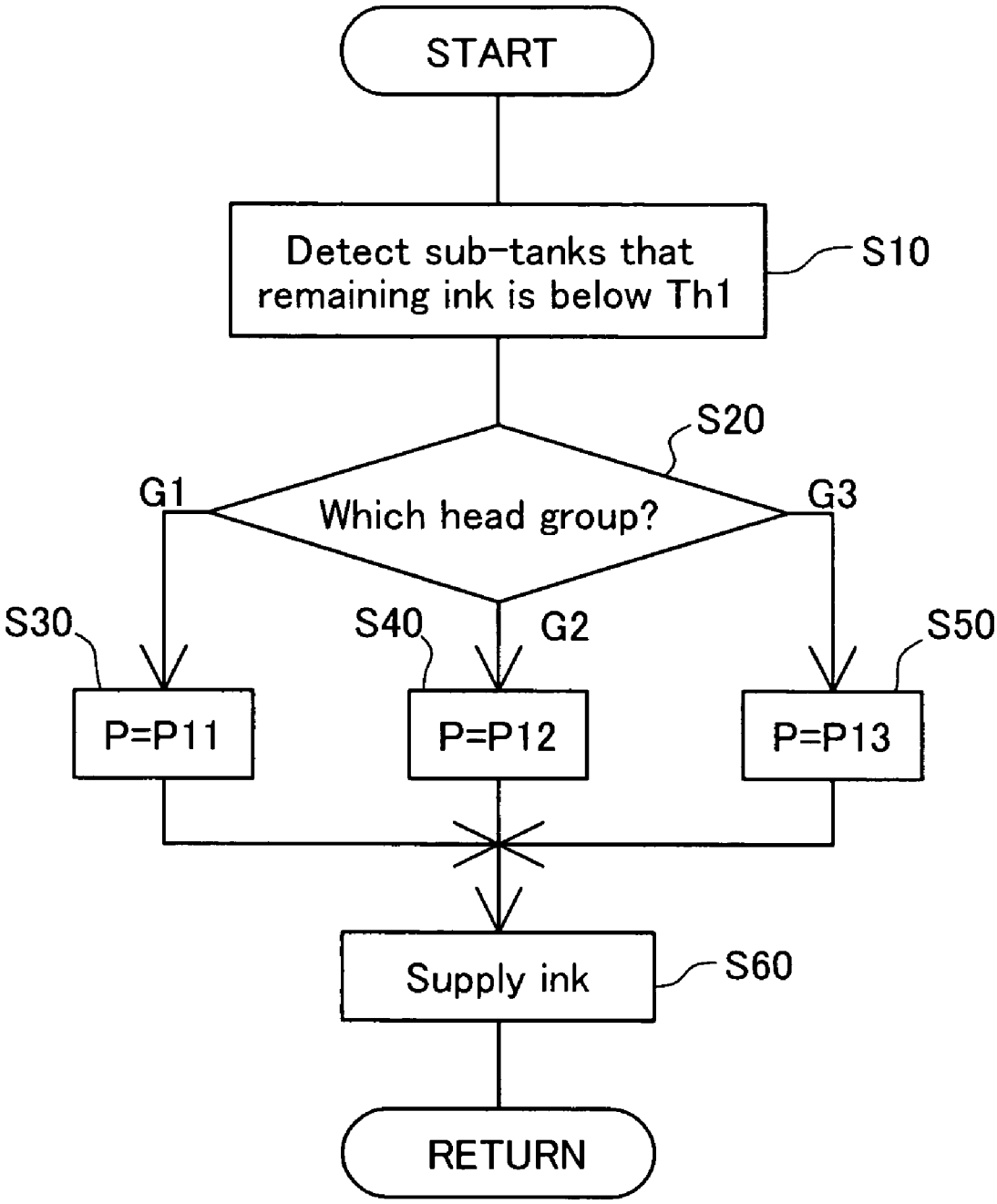
FIG. 9 is a flow chart that shows the procedure for supplying ink from the main tank to the sub-tank while the printer is executing the printing.

FIG. 9 is a flow chart that shows the procedure for supplying ink from the main tank 9 to the sub-tank 3 while the printer is executing the printing. In Step S10, if the CPU 41 detects the sub-tank 3 of which the ink remaining amount is below the lower limit Th1, the CPU 41 decides the sub-tank group to which the detected sub-tank 3 belongs in Step S20.

In the case where the detected sub-tank3 belongs to the sub-tank group G1 that has the highest position on the carriage 1, the CPU 41 sets the pressure Pa of the compressed air supplied by the air pressure pump 921 at P11 in Step S30. Similarly, in the case where the detected sub-tank 3 belongs to the sub-tank group G2, the CPU 41 sets the pressure Pa of the air pressure pump 921 at P12 in Step S40. In the case where the detected sub-tank 3 belongs to the sub-tank group G3, the CPU 41 sets the pressure Pa of the air pressure pump 921 at P13 in Step S50.

The relationship of the values of the pressures is as follows; P11>P12>P13. These values are set so that ink does not seep out from the nozzles when ink is supplied to the sub-tank 3 of each sub-tank group with each pressure value while the printing is executed, i.e. so in the situation that the valve 4 of each sub-tank 3 (See FIG. 7) is opened and ink can be supplied from the sub-tank 3 to the opening 6*o* of the nozzles.

After that, in Step S60 the CPU 41 drives the air pressure pump 921 so that it supplies the air at the set pressure Pa, and opens the valve 926 to supply ink from the main tank 9 to the sub-tank 3.

In the case where ink is supplied to the sub-tank 3 in the sub-tank group G1 that is in the highest position, the pressure of the compressed air supplied to the main tank 9 is set relatively high. Accordingly, the ink supplied from the main tank 9 is supplied in relatively high pressure. In the case where ink is supplied to the sub-tank 3 in the sub-tank group G2, the pressure of the compressed air supplied to the main tank 9 is set lower than that of the case of the sub-tank group G1. Accordingly, the ink supplied from the main tank 9 is supplied at a lower pressure than that in the case of the sub-tank group G1. In the case where ink is supplied to the sub-tank 3 in the sub-tank group G3 that is in the lowest position, the pressure of the compressed air supplied to the main tank 9 is set lower than that in the case of the sub-tank group G2. Accordingly, the ink supplied from the main tank 9 is supplied at a lower pressure than that in the case of the sub-tank group G2.

"The pressure" of the ink means the pressure in the main tank 9 or the pressure in the part of the ink supplying lines 103 from the ink supplying aperture 924*o* of the main tank 9 to the branch point of the ink supplying lines 103 to each sub-tank. The pressure in the main tank 9 or in the part from the ink supplying aperture 924*o* to the branch point corresponds to the ink supplying line used for both of the ink supplies to the first and second sub-tanks.

In this embodiment, in the case where ink is supplied from the main tank 9 to the sub-tank 3 while printing is executed, the ink is supplied to the sub-tank 3 at the pressure such that the ink doesn't seep out from the nozzles. Accordingly, printing matters are not soiled when ink is supplied to the sub-tank 3 while printing is executed. To the sub-tank 3 in the sub-tank group G1 that is set in the higher position than the sub-tank group G2 or G3, ink is supplied with the higher pressure than the sub-tank 3 in the sub-tank group G2 or G3. Accordingly, ink can be supplied to the sub-tank 3 in the sub-tank group G1 of which the water head pressure is higher than that of the sub-tank group G2 or G3.

In the embodiment in which the pressure of the ink supplied to sub-tank 3 is set at the higher value in the range such that ink does not seep out from the nozzles, the sub-tank can be filled with the supplied ink in shorter time. In this embodiment, each sub-tank group can be supplied ink with the independent pressure respectively. Accordingly, the pressure of ink supply to each sub-tank group can be set to the most appropriate values respectively.

2. Ink supply between the printings of images:

After the printing of one image is completed and before the printing of another image starts, the CPU 41 in the printer 200 checks whether the ink remaining amount of each sub-tank 3 is below the second threshold Th2. The second threshold Th2 is set higher than the first threshold Th1. To the sub-tank 3 of which the ink remaining amount is below the second threshold Th2, ink is supplied from the main tank 9 using the procedure described below. In the following paragraphs, the procedure is explained using one pair of the main tank and the sub-tank 3. But, the ink supply from the main tank to sub-tank 3 is executed similarly for 6 sub-tanks, 3 on each of 17 print heads.

Figure 10:
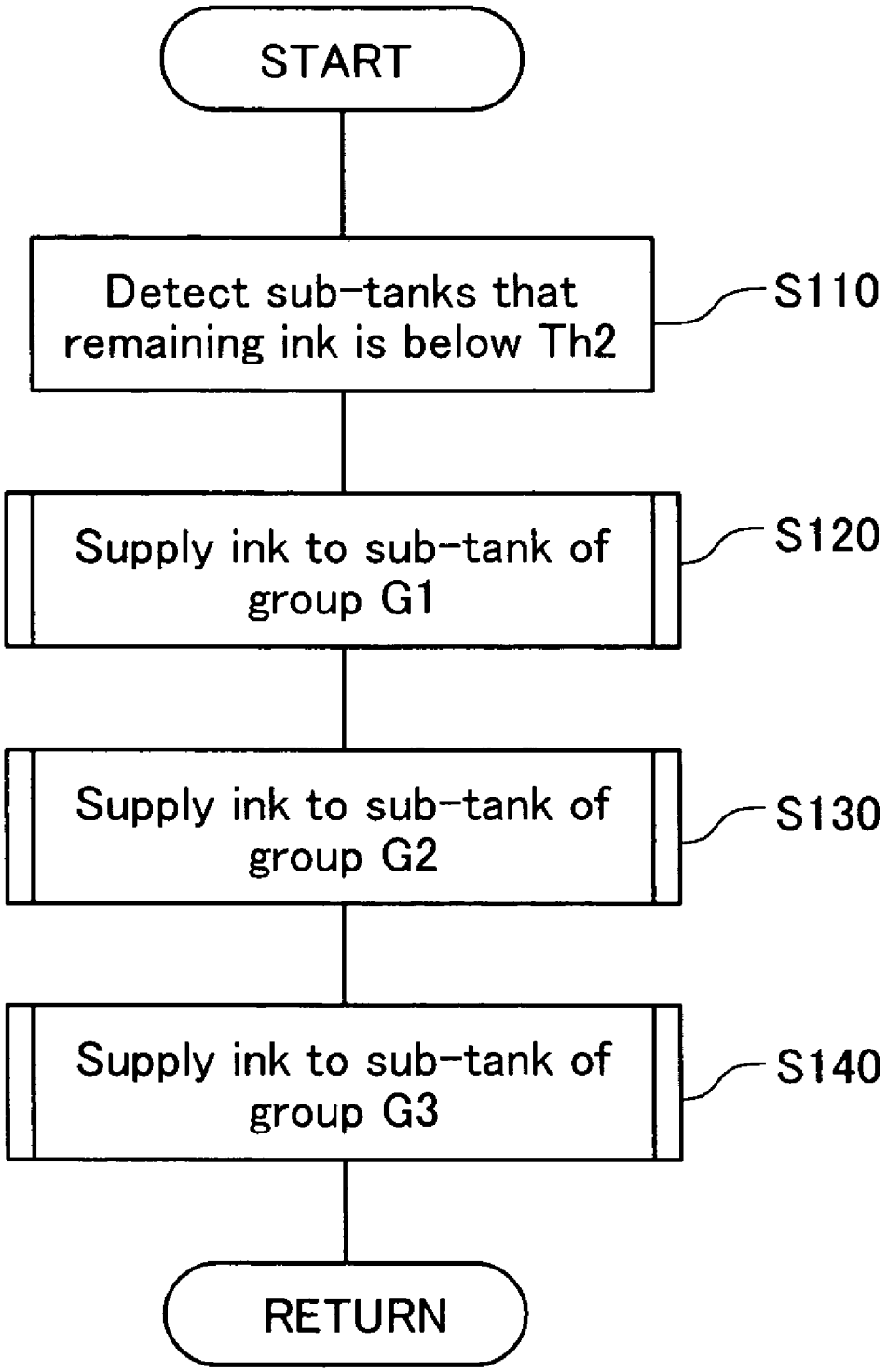
FIG. 10 shows the flowchart of the procedure for supplying ink from the main tank to the sub-tank after the printing of one image is completed and before the printing of another image starts.

FIG. 10 shows the flowchart of the procedure for supplying ink from the main tank 9 to sub-tank 3 after the printing of one image is completed and before the printing of another image starts. In Step S110, the CPU 41 detects the sub-tank 3 of which the ink remaining amount is below the second threshold Th2. In Step S120, the CPU 41 provides instruction to supply ink from the main tank 9 to the detected sub-tank 3 which is connected to the print head in the area of the sub-tank group G1. In Step S130 the CPU 41 supplies ink from the main tank 9 to the detected sub-tank 3 which is connected to the print head in the area of the sub-tank group G2. In Step S140, the CPU 41 supplies ink from the main tank 9 to the detected sub-tank 3 which is connected to the print head in the area of the sub-tank group G3.

Figure 11:
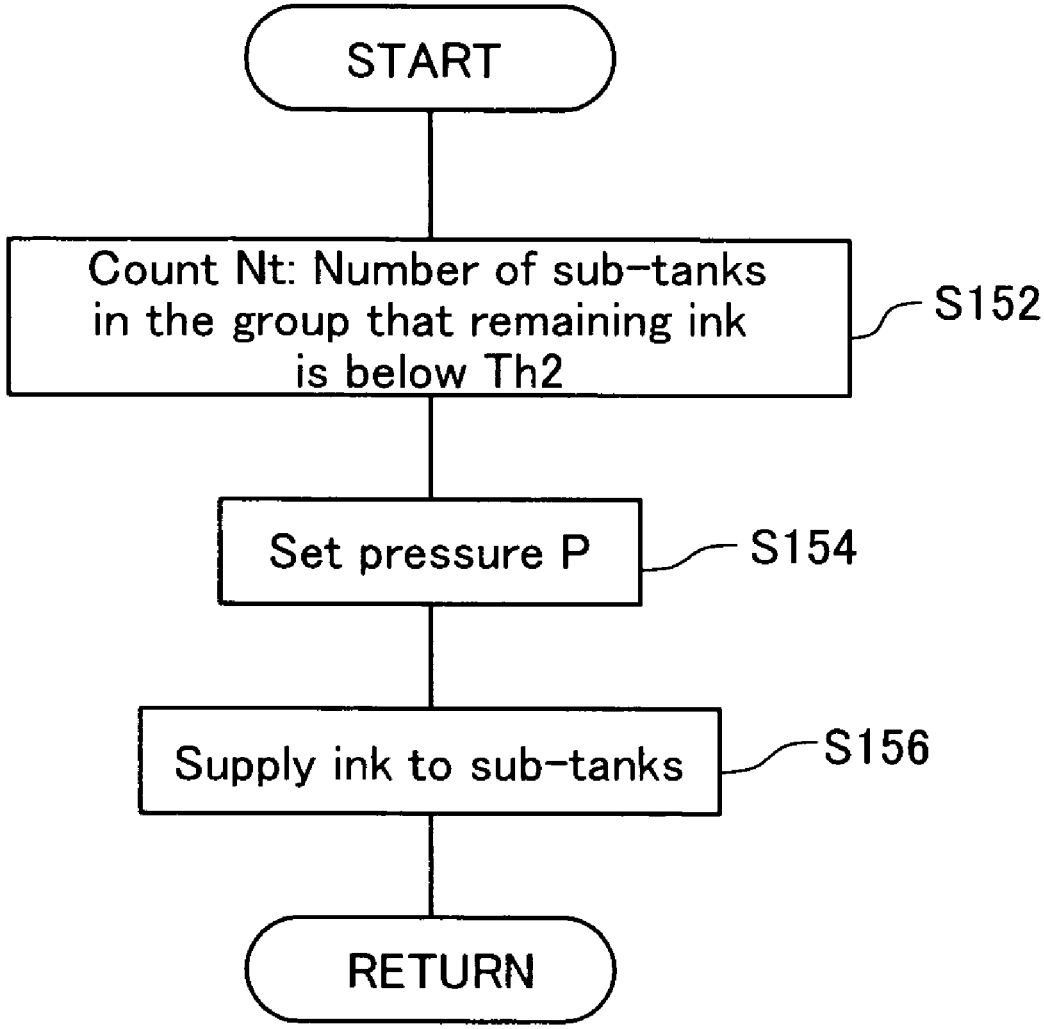
FIG. 11 shows the flowchart of the procedure for supplying ink from the main tank to the sub-tank of sub-tank groups depicted in FIG. 10.

FIG. 11 shows the flowchart of the procedure for supplying ink from the main tank 9 to sub-tank 3 of each sub-tank group in Steps S120 to S140 of FIG. 10. When ink is supplied to the sub-tank 3 of each sub-tank group, in Step S152, the CPU 41 counts Nt that is the number of sub-tanks 3 in the each sub-tank group of which the ink remaining amount is below the second threshold Th2. Then the CPU 41 sets the value Pa of the pressure of the compressed air supplied by the air pressure pump 921.

FIG. 12 shows the table for defining the value of the pressure of compressed air supplied by the air pressure pump 921. In Step S154, the value Pa of the pressure of the compressed air supplied by the air pressure pump 921 is decided according to the type G1 to G3 of sub-tank group and the number of sub-tanks 3 in which ink is to be replenished. The total number of sub-tanks belonging to each sub-tank group is 5 or 6. The value of the pressure of compressed air is defined according to the number of the sub-tanks to be supplied the ink, i.e. 1 to 5 or 6 as shown in FIG. 12. The 9 characters of P11 to P33 represent the pressure values respectively. The pressure values in the same column (such as P11, P21, P31) are each lower than the value underneath (that is, the values increase in descending order). The pressure values in the same row (such as P21, P22, P23) are each lower than the preceding value (greater on the left, lower on the right) Furthermore, P11>P32, and P12>P33.

After that, in Step S156 of FIG. 11, CPU 41 drives the air pressure pump 921 so that it operates with the pressure Pa set in the Step 154, opens the valve 926 and supplies the ink from the main tank 9 to sub-tank 3.

In this embodiment, when ink is supplied in the period between the printings of images, the pressure of ink supply is higher in the order of G3, G2 and G1 in the case where the same number of sub-tanks are supplied ink. Accordingly, ink can be supplied to the sub-tanks placed in relatively higher position, while ink can be supplied to the sub-tanks placed in relatively lower position at the pressure such that ink does not get out from the nozzle when it is supplied.

Also, when ink is supplied to sub-tanks 3 connected to the same sub-tank group, the greater the number of sub-tanks 3 to which ink is supplied, the higher the air pressure of the compressed air supplied to the main tank 9, resulting in a high ink supply pressure. As such, the amount of ink ejected from the main tank 9 per unit time is greater, the greater the number of sub-tanks 3 to which ink is supplied. Thus, even when ink is supplied to many sub-tanks 3, the ink can be replenished sooner than when the ink supply pressure is constant, irrespective of the number of sub-tanks 3.

For example, suppose that the first pressure is the ink supplying pressure P21 in FIG. 12 that is the pressure when 3 or 4 sub-tanks in sub-tank group G1 are supplied ink; and the second pressure is the ink supplying pressure P22 that is the pressure when 3 or 4 sub-tanks in sub-tank group G2 are supplied ink. In this case, the relationship of the first and the second pressure is P21>P22, i.e. the first pressure is higher than the second pressure.

In case the first pressure is supposed to be the ink supplying pressure P21, the ink supplying pressure P31 is the higher pressure than the first pressure. P21 is the pressure when 3 or 4 sub-tanks in sub-tank group G1 are supplied ink. P31 is the pressure when 5 or 6 sub-tanks in sub-tank group G1 are supplied ink. The relationship between these pressures is P31>P21.

In case the second pressure is supposed to be the ink supplying pressure P22, the ink supplying pressure P12 is at a lower pressure than the second pressure. P22 is the pressure when 3 or 4 sub-tanks in sub-tank group G2 are supplied ink. P12 is the pressure when 1 or 2 sub-tanks in sub-tank group G2 are supplied ink. The relationship between these pressures is P22>P12.

In this embodiment, when one printing of the image is completed, the sub-tanks of which the ink remaining amounts are low are supplied ink. Accordingly, the next printing can be started with the sub-tanks 3 containing enough amount of ink. The second threshold Th2 is set at a higher value than the first threshold Th1. Consequently, when the printing of the image is completed, the sub-tank 3 that is supplied ink is the sub-tank 3 of which the remaining amount of the ink is higher than the case of the ink supply during the printing. In other words, the sub-tank 3 of which the remaining amount of the ink is more than Th1 and less than Th2 is also supplied ink as well as the sub-tank 3 of which the remaining amount of the ink is less than Th1. Based on this point, the next printing can be started with the sub-tanks 3 containing enough amount of ink. In this embodiment, when one printing of the image is completed, only the sub-tanks of which the ink remaining amounts are low are supplied with ink. Accordingly, this printing system doesn't have to stop printing for a long time to supply ink before the next printing of image.

In this embodiment of the printing device, the nozzle plates 2*a*, 2*b* and 2*c*, in which the openings of nozzles are arranged, are configured to be set in an inclined situation or attitude with specific angle to the horizontal plane. Accordingly, each sub-tank can be set in the position such that the fluid level of the ink in the sub-tank is lower than the position of the opening of the nozzle. It would be better to construct the printer such that the nozzle plates face to the printing medium. In such a printer, it is difficult to set the sub-tank in the position such that the fluid level of the ink in the sub-tank is lower than the position of the opening of the nozzle, in case that the nozzle plates are set in the situation parallel to the horizontal plane and ink is ejected vertically downward.

The nozzle plates 2*a*, 2*b* and 2*c* are configured in the situation or attitude such that ink is ejected along the obliquely downward direction. Accordingly, the ink can be deposited on more correct position than the aspect that ink is ejected along the upward or obliquely upward direction. Furthermore, the nozzle plates 2*a*, 2*b* and 2*c* can not be soiled by the ink that is ejected upward and fall down to the nozzle plates 2*a*, 2*b* and 2*c*.

C. Variation:

The present invention is not limited to the above-mentioned embodiments or aspects, and can be implemented in a variety of modes whose scopes do not deviate from the principles described herein. For example, a variation such as the following is also possible.

C1. Variation 1:

In the above embodiments, when ink is supplied to the sub-tank while printing is being executed, one sub-tank is supplied ink from the main tank at once. But, a plurality of sub-tanks can be supplied ink simultaneously, when ink is supplied to the sub-tank while printing is executed. In such an embodiment, the pressure may be set based on the table in FIG. 12 as well as the ink supply between the printings.

While the first sub-tank in sub-tank group G1 is being supplied ink with the pressure P11, the ink remaining amount of the second sub-tank in the sub-tank group G1 may go below Th1. In such case, these two sub-tanks can be supplied ink with the pressure P11 (See. FIG. 12). While the first and second sub-tanks in sub-tank group G1 are being supplied ink with the pressure P11, the ink remaining amount of the third sub-tank in the sub-tank group G1 may go below Th1. In such case, these three sub-tanks can be supplied ink with the pressure P21 along the table in FIG. 12. When ink supply to the first sub-tank is completed, the second and third sub-tanks can be supplied ink with the pressure P11 along the table in FIG. 12.

The control unit in the printing device preferably keeps monitoring the remaining amount of the ink in each sub-tank, while ink is being supplied to some sub-tanks. When such sub-tank is detected that it belongs to the same sub-tank group with the sub-tank being supplied ink and its ink remaining amount is below the specific value Th1, it is preferable that the detected sub-tank is also supplied ink simultaneously. The pressure with which ink is supplied to the sub-tanks may preferably be modified according to the number of sub-tanks to be supplied ink. The pressure during the supply of ink may be set higher, the greater the number of sub-tanks in which ink is being replenished. The amount of ink supplied per unit time may also be greater, the greater the number of sub-tanks in which ink is being replenished.

C2. Variation 2:

In the above mentioned embodiment, the sub-tank group G1 is set in the relatively high position and the sub-tank group G2 is set in the relatively low position. The pressure with which the sub-tank in sub-tank group G1 is supplied ink from the main tank is higher than the pressure with which the sub-tank in sub-tank group G2 is supplied ink from the main tank regardless of the number of the sub-tank supplied ink. That is P11>P32 as shown in FIG. 12.

But, the pressure with which a relatively small number of sub-tanks in sub-tank group G1 are supplied ink from the main tank simultaneously may be lower than the pressure with which a relatively large number of sub-tanks in sub-tank group G2 are supplied ink from the main tank simultaneously. The aspects described below are included in the situations in which "when the first sub-tank in the relatively high position is supplied ink, the ink is supplied from the main tank at the first pressure that is relatively high, and when the second sub-tank in the relatively low position is supplied ink, the ink is supplied from the main tank at the second pressure that is relatively low". The included aspect is as follows. In the aspect, the first sub-tank group is set in the relatively high position and the second sub-tank group is set in the relatively low position. The pressure with which the sub-tank in the first sub-tank group is supplied ink from the main tank is higher than the pressure with which the sub-tank in the second sub-tank group is supplied ink from the main tank when the numbers of sub-tanks in both sub-tank groups to be supplied ink is same. The above mentioned situation includes this aspect.

In the above mentioned embodiment, when the sub-tanks in the same sub-tank group are supplied ink, the number of the sub-tanks to be supplied ink may be 1 to 6. The pressures of ink supply from the main tank were set in three patterns. But, this invention is not limited in such aspect. The pressures of the ink supply at the main tank can be set to a different value according to the number of sub-tanks to be supplied ink. The pressures at the main tank can also be set loosely, i.e. in fewer patterns than the above-mentioned embodiment. For example, the pressures of ink supply at the main tank may be set in 2 patterns, while the number of the sub-tanks to be supplied ink may be 1 to 6. The pressure can also be set based on the mathematical formula to be substituted the number of the sub-tanks as well as on the tables or the maps.

C3. Variation 3:

In the above-mentioned embodiment, ink is supplied from the main tank 9 by feeding the compressed air from outside into the pressure chamber 925 of the main tank 9. In other words, the ink replenishment unit comprises the air pressure pump 921, the air supplying line of the compressed air, the outer case 920 of the main tank 9, the ink supplying lines 103, and the ink supplying valve 926. But, ink can be supplied using other means. In one embodiment, ink supplying means that can deal with the ink directly, e.g. a diaphragm pump, may be applied. The ink supplying means can be constructed as the means that can supply ink from the main tank to the sub-tank with a plurality of different values of pressures.

C4. Variation 4:

In above embodiment, the CPU 41 calculates the remaining amount of the ink in the sub-tank by detecting the fluid level of the ink in the sub-tank with the float unit 331 and the magneto electric conversion devices 333*a*, 333*b*. The remaining amount of the ink in the sub-tank can be calculated with other means. For example, the embodiment described below can be applied.

In one embodiment, while printing is being executed, the CPU 41 monitors the number of times that ink droplets are ejected from each nozzle connected to each sub-tank 3 and the number of times that the cleaning of nozzles connected to each sub-tank 3 is carried out. The CPU 41 keeps calculating the consumed ink amount in the sub-tank 3 based on this while printing is executed. By doing so, the CPU 41 monitors whether the remaining amount of the ink in each sub-tank 3 go belong the first threshold Th1 while printing is executed. In this embodiment, the CPU corresponds to the remaining amount monitoring unit.

In another embodiment, the ink holding tank can be made as transparent or translucent. In such an embodiment, the CPU 41 can monitor the existence of ink at a specific level of the ink tank from outside with the light sensor, and calculate the remaining amount of the ink. In a different or same embodiment, two electrodes may be equipped in the ink tank so that while both of them are immersed in the ink, the electricity is on. In such an embodiment, the remaining amount of the ink can be monitored. Accordingly, the sub-tank may be constructed so that the fact that the remaining amount of ink below the specific threshold can be detected.

C5. Variation 5:

This invention may be applied to the dram scan printers. This invention may be also applied broadly to a printing device which ejects ink from the print head to print images and is not limited to the ink jet printer. As such a printing device, there is the facsimile machine or the copy machine, for example.

C6. Variation 6:

In each of the above embodiments, software can be substituted for a portion of the constitution achieved by hardware, and conversely, hardware can be substituted for a portion of the constitution achieved via software. For example, it is also possible to achieve a portion of the functionality of the control circuit 40 in the printer 200 shown in FIG. 8 using software executed in the computer 90.

The Program product may be realized as many aspects. For example:

(i) Computer readable medium, for example the flexible disks, the optical disk, or the semiconductor memories;

(ii) Data signals, which comprise a computer program and are embodied inside a carrier wave;

(iii) Computer including the computer readable medium, for example the magnetic disks or the semiconductor memories; and (iv) Computer temporally storing the computer program in the memory through the data transferring means.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure at a common-use ink supplying line used for ink supply to both the first and second sub-tanks; and supplying ink from the main tank to the second sub-tank at a second pressure that is lower than the first pressure at the common-use ink supplying line, wherein the ink is supplied from the main tank to the first sub-tank without going through the second sub-tank, and the ink is supplied from the main tank to the second sub-tank without going through the first sub-tank.

2. The method according to claim 1, wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

3. The method according to claim 1, wherein the printing device further includes a carriage which reciprocates at a position where the carriage faces a printing medium, and the plurality of the nozzles and the first and second sub-tanks are provided on the carriage.

4. The method according to claim 1, wherein the printing device further includes a plurality of the first sub-tanks, wherein the method further comprises:

determining whether the remaining amount of ink is below a threshold level in the plurality of first sub-tanks, and supplying ink simultaneously from the main tank to one or more first sub-tanks of which the remaining amount of ink is below the threshold, where ink is supplied from the main tank in a relatively high amount of ink per unit time when the ink is supplied simultaneously to a relatively large number of first sub-tanks; and ink is supplied from the main tank in a relatively low amount of ink per unit time when the ink is simultaneously supplied to a relatively small number of first sub-tanks.

5. The method according to claim 1, wherein the printing device further includes a plurality of the first sub-tanks, wherein the method further comprises:

determining whether the remaining amount of ink is below a threshold level in the plurality of first sub-tanks, and supplying ink simultaneously from the main tank to one or more first sub-tanks of which the remaining amount of ink is below the threshold, where ink is supplied from the main tank at the first pressure when ink is supplied simultaneously to a relatively small number of first sub-tanks; and ink is supplied from the main tank at a pressure higher than the first pressure when the ink is simultaneously supplied to a relatively large number of first sub-tanks.

6. The method according to claim 1, wherein the printing device further includes a plurality of the second sub-tanks, wherein the method further comprises:

determining whether the remaining amount of ink is below a threshold level in the plurality of second sub-tanks, and supplying ink simultaneously from the main tank to one or more second sub-tanks of which the remaining amount of ink is below the threshold, where ink is supplied from the main tank in a relatively high amount of ink per unit time when ink is supplied simultaneously to a relatively large number of second sub-tanks; and ink is supplied from the main tank in a relatively low amount of ink per unit time when the ink is simultaneously supplied to a relatively small number of second sub-tanks.

7. The method according to claim 1, wherein the printing device further includes a plurality of the second sub-tanks, wherein the method further comprises:

determining whether the remaining amount of ink is below a threshold level in the plurality of second sub-tanks, and supplying ink simultaneously from the main tank to one or more second sub-tanks of which the remaining amount of ink is below the threshold, where ink is supplied from the main tank at the second pressure when ink is supplied simultaneously to a relatively large number of second sub-tanks; and ink is supplied from the main tank at a pressure lower than the second pressure when the ink is simultaneously supplied to a relatively small number of second sub-tanks.

8. A printing apparatus for printing by ejecting ink from nozzles onto a printing medium, comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles;

a main tank which is connected to the first and second sub-tanks and holds ink to be supplied to the first and second sub-tanks;

an ink supplying line which is used for supplying ink to both the first and second sub-tanks; and an ink replenishment unit for supplying ink from the main tank to the first and second sub-tanks selectively, wherein the ink replenishment unit is operable to supply ink from the main tank to the first sub-tank at a first pressure at a common-use ink supplying line used for ink supply to both the first and second sub-tanks; and supply ink from the main tank to the second sub-tank at a second pressure that is lower than the first pressure at the common-use ink supplying line, wherein the ink is supplied from the main tank to the first sub-tank without going through the second sub-tank, and the ink is supplied from the main tank to the second sub-tank without going through the first sub-tank.

9. The printing apparatus according to claim 8, wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

10. The printing apparatus according to claim 8, further comprising a carriage which reciprocates at a position where the carriage faces a printing medium, wherein the plurality of the nozzles and the first and second sub-tanks are provided on the carriage.

11. A computer product operable to control ink supply from a main tank to sub-tanks of a printing device, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles;

a main tank which is connected to the first and second sub-tanks and holds ink to be supplied to the first and second sub-tanks;

wherein the computer product comprises:

a computer readable medium; and a computer program stored on the computer readable medium, the computer program comprising:

instructions operable to control supply of ink from the main tank to the first sub-tank at a first pressure at a common-use ink supplying line used for ink supply to both the first and second sub-tanks; and instructions operable to control ink supply from the main tank to the second sub-tank at a second pressure that is lower than the first pressure at the common-use ink supplying line, wherein the ink is supplied from the main tank to the first sub-tank without aoing through the second sub-tank, and the ink is supplied from the main tank to the second sub-tank without going through the first sub-tank.

12. A computer program product according to claim 11, wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

13. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure that is high relative to a second pressure at an ink supplying line used for ink supply to both the first and second sub-tanks; and supplying ink from the main tank to the second sub-tank at the second pressure that is lower than the first pressure at the ink supplying line, wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

14. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure that is high relative to a second pressure at an ink supplying line used for ink supply to both the first and second sub-tanks; and supplying ink from the main tank to the second sub-tank at the second pressure that is lower than the first pressure at the ink supplying line, and wherein the printing device further includes a plurality of the first sub-tanks, wherein the method further comprises:

determining whether the remaining amount of ink is below a threshold level in the plurality of first sub-tanks, and supplying ink simultaneously from the main tank to one or more first sub-tanks of which the remaining amount of ink is below the threshold, where ink is supplied from the main tank in a relatively high amount of ink per unit time when the ink is supplied simultaneously to a relatively large number of first sub-tanks; and ink is supplied from the main tank in a relatively low amount of ink per unit time when the ink is simultaneously supplied to a relatively small number of first sub-tanks.

15. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure that is high relative to a second pressure at an ink supplying line used for ink supply to both the first and second sub-tanks; and supplying ink from the main tank to the second sub-tank at the second pressure that is lower than the first pressure at the ink supplying line wherein, the printing device further includes a plurality of the first sub-tanks, wherein the method further comprises:

determining whether the remaining amount of ink is below a threshold level in the plurality of first sub-tanks, and supplying ink simultaneously from the main tank to one or more first sub-tanks of which the remaining amount of ink is below the threshold, where ink is supplied from the main tank at the first pressure when ink is supplied simultaneously to a relatively small number of first sub-tanks; and ink is supplied from the main tank at a pressure higher than the first pressure when the ink is simultaneously supplied to a relatively large number of first sub-tanks.

16. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure that is high relative to a second pressure at an ink supplying line used for ink supply to both the first and second sub-tanks; and supplying ink from the main tank to the second sub-tank at the second pressure that is lower than the first pressure at the ink supplying line, wherein the printing device further includes a plurality of the second sub-tanks, wherein the method further comprises:

determining whether the remaining amount of ink is below a threshold level in the plurality of second sub-tanks, and supplying ink simultaneously from the main tank to one or more second sub-tanks of which the remaining amount of ink is below the threshold, where ink is supplied from the main tank in a relatively high amount of ink per unit time when ink is supplied simultaneously to a relatively large number of second sub-tanks; and ink is supplied from the main tank in a relatively low amount of ink per unit time when the ink is simultaneously supplied to a relatively small number of second sub-tanks.

17. A method for supplying ink from a main tank to sub-tanks in a printing device which executes printing by ejecting ink from nozzles onto a printing medium, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles; and a main tank which is connected to the first and second sub-tanks and holds ink to be supplied to the first and second sub-tanks;

the method including:

supplying ink from the main tank to the first sub-tank at a first pressure that is high relative to a second pressure at an ink supplying line used for ink supply to both the first and second sub-tanks; and supplying ink from the main tank to the second sub-tank at the second pressure that is lower than the first pressure at the ink supplying line, wherein the printing device further includes a plurality of the second sub-tanks, wherein the method further comprises:

determining whether the remaining amount of ink is below a threshold level in the plurality of second sub-tanks, and supplying ink simultaneously from the main tank to one or more second sub-tanks of which the remaining amount of ink is below the threshold, where ink is supplied from the main tank at the second pressure when ink is supplied simultaneously to a relatively large number of second sub-tanks; and ink is supplied from the main tank at a pressure lower than the second pressure when the ink is simultaneously supplied to a relatively small number of second sub-tanks.

18. A printing apparatus for printing by ejecting ink from nozzles onto a printing medium, comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles;

a main tank which is connected to the first and second sub-tanks and holds ink to be supplied to the first and second sub-tanks;

an ink supplying line which is used for supplying ink to both the first and second sub-tanks; and an ink replenishment unit for supplying ink from the main tank to the first and second sub-tanks selectively, wherein the ink replenishment unit is operable to supply ink from the main tank to the first sub-tank at a first pressure that is high relative to a second pressure at an ink supplying line used for ink supply to both the first and second sub-tanks; and supply ink from the main tank to the second sub-tank at the second pressure that is low relative to the first pressure at the ink supplying line, and wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

19. A computer product operable to control ink supply from a main tank to sub-tanks of a printing device, the printing device comprising:

a plurality of nozzles for ejecting ink drops;

a first sub-tank which is provided at a high position relative to a second sub-tank and which holds ink to be supplied to one part of the plurality of the nozzles;

the second sub-tank which is provided at a low position relative to the first sub-tank and which holds ink to be supplied to another part of the plurality of the nozzles;

a main tank which is connected to the first and second sub-tanks and holds ink to be supplied to the first and second sub-tanks;

wherein the computer product comprises:

a computer readable medium; and a computer program stored on the computer readable medium, the computer program comprising:

instructions operable to control supply of ink from the main tank to the first sub-tank at a first pressure that is relatively high at an ink supplying line used for ink supply to both the first and second sub-tanks; and instructions operable to control ink supply from the main tank to the second sub-tank at a second pressure that is relatively low at the ink supplying line, wherein the first pressure is set such that ink does not seep out from the nozzle when ink is supplied from the main tank to the first sub-tank in a situation that ink can be supplied from the first sub-tank to an opening of the nozzle;

the second pressure is set such that ink does not seep out from the nozzle when ink is supplied from the main tank to the second sub-tank in a situation that ink can be supplied from the second sub-tank to an opening of the nozzle.

* * * * *